United States Patent [19]

Bernhardt et al.

[11] 4,325,410

[45] Apr. 20, 1982

[54] CONTROL DEVICE FOR A HYDRAULICALLY OPERATED LOAD

[76] Inventors: Wolfgang Bernhardt, Tubizer Str. 21, 7015 Konntal-Münchingen; Heinz Kleinschmidt, Bauernstr. 71, 7257 Ditzingen; Joachim Heiser, Bockelstr. 92A, 7000 Stuttgart 75, all of Fed. Rep. of Germany

[21] Appl. No.: 969,218

[22] Filed: Dec. 13, 1978

[30] Foreign Application Priority Data

Jan. 31, 1978 [DE] Fed. Rep. of Germany ..... 2804045

[51] Int. Cl.[3] ..... F15B 13/04; F15B 13/08

[52] U.S. Cl. ..... 137/596.13; 91/451

[58] Field of Search ..... 137/596.13; 91/451

[56] References Cited

U.S. PATENT DOCUMENTS 3,815,477 6/1974 Ailshie et al. ..... 137/596.13 X 3,924,655 12/1975 Schwerin ..... 137/596.13

*Primary Examiner*—Gerald A. Michalsky

[57] ABSTRACT

The control device for a hydraulically operated load includes a multiway piston valve defining a plurality of working chambers, a plurality of control chambers, a piston having axial and radial bores acting as first choke channels and a control collar cooperating with the control chambers to act as additional choke channels, a piston manometer valve biased by a spring and connected between a pump channel and a return flow channel. A control conduit including at least one choke is connectable via additional choke channels between the pump channel and the return flow channel and has a branch conduit leading to the spring-biased end of the manometer piston. The valve piston is displaceable from its neutral position into an intermediate control position in which in the range of the fine adjustment of the flow the pressure from the load is applied through the control conduit to the manometer piston to provide a load compensated control. In the end control position of the multiway piston the load compensated control is disconnected and maximum through-flow is attained.

10 Claims, 4 Drawing Figures

CONTROL DEVICE FOR A HYDRAULICALLY OPERATED LOAD

BACKGROUND OF THE INVENTION

This invention relates generally to a control device for a hydraulically operated load and more particularly, it relates to a load independent control device for regulating flow of a hydraulic fluid including at least one multiway piston valve which has a housing and, within the housing, a longitudinal boring for slidably guiding the valve piston between a neutral position and a plurality of control positions, a fluid inlet channel connectable to a pump, a load channel connectable to a load, a fluid return channel connectable to a tank, the piston including at least one choke channel for selectively connecting in one position thereof the control inlet channel to the load channel and in another position thereof the load channel to the return channel, a spring-biased piston manometer valve connected between the inlet channel and the return channel, and being additionally biased by the pressure difference on a choke to maintain a constant pressure difference in individual channels, a control conduit connected between the inlet channel and the return channel and including a branch conduit to additionally bias the piston of the manometer control valve.

From prior art a control device of this type is known in which the piston of the multiway valve can take a neutral position and only two working positions in which a first control conduit is fully activated whereas choking points are operated in response to the movement of the piston to choke the flow proportionally to the displacement of the latter. At the same time, the load pressure is always transmitted via another control conduit to a piston manometer valve. The disadvantage of this known control device is the fact that the other control conduit to the load cannot be fully shut off and consequently the choking action in the first control conduit in the range of a fine adjustment of the device is impossible. It is also impossible to increase the effective pressure difference to attain maximum working fluid flow to the load. Another disadvantage of this known device results from the streaming of the working oil to the load via choking non-return valves. This choked streaming in the case of a parallel operation of several loads causes a limited unloading and leads indeed to an additional energy consumption (British Pat. No. 1,401,602).

Furthermore, a control device for a hydraulic load having a load independent flow regulation is known which is designed without any control conduit from the pump channel communicating via a choke and a choke channel in the piston with the tank. The omission of this control conduit means that in the end positions of the piston the influence of the load compensation cannot be fully eliminated and consequently the piston manometer valve is not exposed to the full pump pressure in lieu of the load pressure but to an intermediate pressure which more or less deviates from the pump pressure. This intermediate control pressure is to be applied to the manometer piston via a branched narrow channel system. It is true that this arrangement permits in the end position of the piston of the multiway valve to apply full pump stream to the load provided that the spring biasing the piston of the manometer valve is correspondingly strong; nonetheless, this design results in considerable losses of energy in the neutral position of the piston. Moreover, the construction of this prior art control device necessitates a hollow piston with non-return valves arranged in its interior and thus the whole structure is relatively expensive. In addition, this control device has the disadvantage that the load pressure due to the location of the non-return valves is tapped off at the point where the pressure is reduced about the pressure difference caused by the non-return valves and consequently the piston valve manometer has to be adjusted for correspondingly higher pressures with the result that additional energy losses take place (German Pat. No. 1,959,764).

SUMMARY OF THE INVENTION

It is, therefore, a general object of the present invention to overcome the aforementioned disadvantages.

More particularly, it is an object of the invention to provide an improved load independent flow controlling device for a hydraulic load which enables in the range of fine adjustment of the flow between the neutral position and the end position of the multiway control piston a load compensated flow adjustment which is discontinued in the end position of the piston so that in this end position a maximum flow to the load is possible.

An additional object of the invention is to provide such an improved controlling device which in its neutral position has very low energy losses inasmuch as it permits the biasing of the piston manometer valve only by a weak spring and consequently the pump can operate only at a low pressure.

In keeping with these objects and others which will become apparent hereafter, one feature of the invention resides, in a controlling device of the above-described type, in a combination which comprises a directional multiway piston valve, the piston of which is movable from its neutral position into an intermediate control position in which a first choke channel in the valve is made effective and the first control conduit is open, the first control conduit being connected to a second choke channel provided in the valve for increasing the spring bias on the piston of the manometer valve, and the multiway piston being further movable into an end control position in which the choke channel is fully open and thus made ineffective and the first control conduit is interrupted.

This combination makes it possible that in the intermediate control position of the multiway piston valve in which the fine adjustment of the flow takes place is compensated against load variation and in the second control position of the piston this load compensation is removed so that the maximum flow is admitted to the load.

Preferably, the second choke channel is shut off in response to the change of position of the multiway piston so that the loss of energy in the pump can be kept very low in the neutral position of the valve because the pressure increase resulting in the second choke channel and normally applied against the manometer valve, is removed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
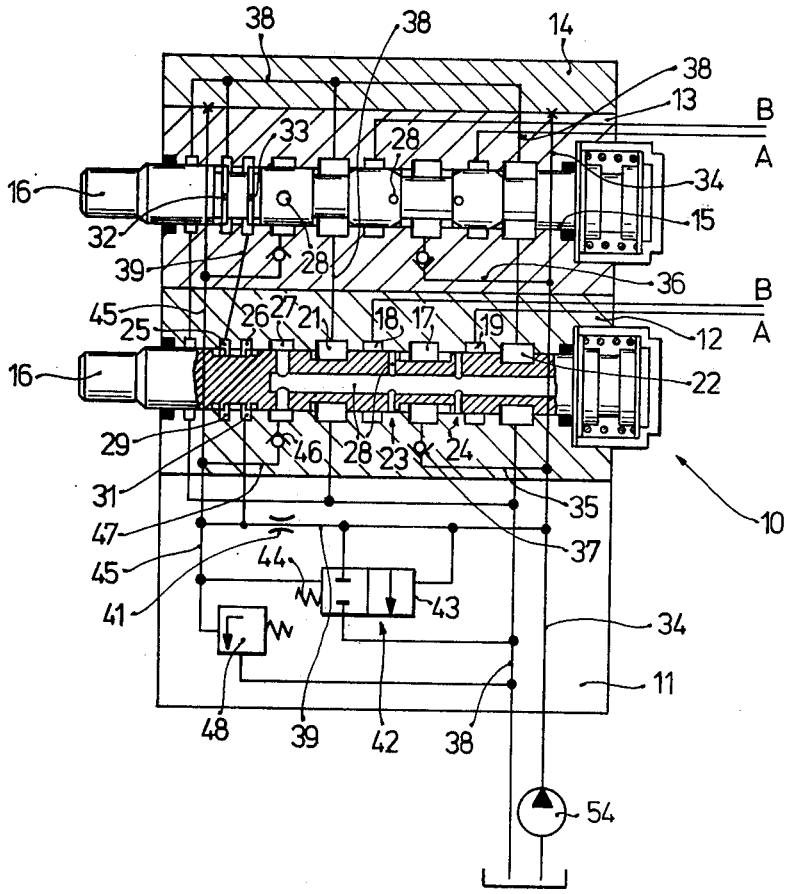
FIG. 1 is a schematic sectional side view of one embodiment of the device of this invention.
Figure 2:
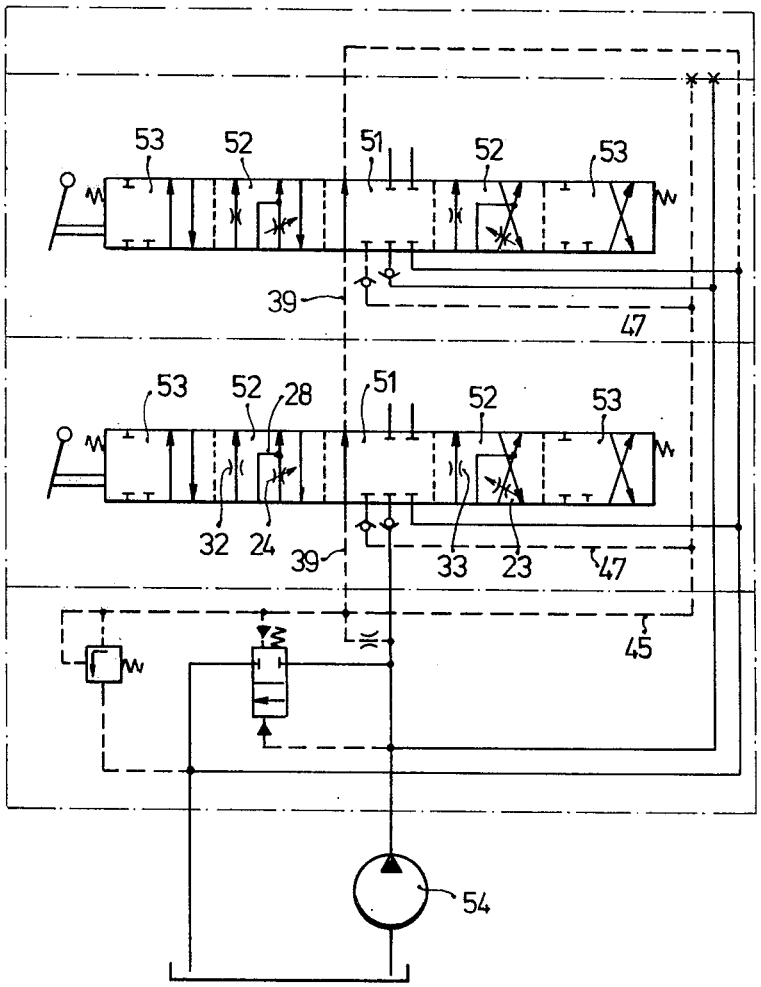
FIG. 2 is a circuit diagram of the device of FIG. 1.

Referring first to FIGS. 1 and 2, the directional control device 10 for hydraulic loads A and B includes a connection plate 11, first multiway valve 12 and a second multiway valve 13 and a terminal plate 14. The construction of both multiway valves 12 and 13 is identical so that the description of only one of these valves, for example valve 12, is sufficient for disclosing the invention.

The multiway valve 12 has an axial boring 15 in its housing in which control piston 16 is movable in two opposite directions. The interior of boring 15 is provided with annular recesses defining respectively an inlet port or chamber 17, load chambers 18 and 19 and return flow chambers 21 and 22. Piston 16 controls in a conventional manner the connection between selected chambers. The interior of piston 16 has an axially directed blind bore communicating with first choke channels 23 and 24 which are adjustable by means of fine adjustment threads and having an effect on the stream of working fluid flowing to the load. Near the return flow chamber 21 in the wall of boring 15, there are consecutively arranged the first control chamber 25, the second control chamber 26 and the third control chamber 27. Load pressure is always applied to the third control chamber 27 via axial and radial bores 28 in piston 16. In the range of the first and second control chambers 25 and 26 the periphery of piston 16 is provided with annular choking recesses or channels 32 and 33 separated by control collars 29 and 31 to modify the flow connection between the first control chamber 25 and the second control chamber 26.

Control device 10 cooperates with a pump 54 from which pressure fluid inlet channels 35 and 36 with non-return valves 37 lead into inlet chamber 17. Device 10 further comprises a branched return channel 38 which connects all return fluid chambers 21 and 22. In connection plate 11 the first control conduit 39 branches from pump channel 34 and continues via the first choke 41 and through the second control chamber 26 and the first control chamber 25 of respective multiway valves 12 and 13 to join return channel 38 in terminal plate 14. In connection plate 11 there is further provided a piston manometer valve 42 having its piston 43 biased by spring 44. Valve 42 controls the connection between the pump channel 34 and the return channel 38. Piston 43 of the manometer valve 42 is furthermore biased from the side opposite the spring 44 by the pressure from pump channel 34 and on the side of biasing spring 44 being additionally biased by a branch conduit from the first control conduits 39, the branching taking place downstream of the first choke 41. This branch conduit from the first control conduit 39 is at the same time connected to a second control conduit 45 through which it can be acted upon by the instant load pressure since channel 47 leads through the first control chamber 27 and a non-return valve 46, provided in both multiway valves 12 and 13, to the second control conduit 45. Pressure limiting valves 48 safeguard the spring loaded end of piston 43 of manometer valve 42.

Referring now to the simplified circuit diagram of device 10 in FIG. 2, piston 16 of each valve 12 or 13 is movable from a neutral position 51 into a left-hand or right-hand intermediate control position 52 and furthermore into corresponding end positions 51. In the intermediate or first control position 52 the first choke channel 23 (or 24) becomes effective and at the same time the load pressure is tapped off via one of radial bores 28. In addition the second choke channel 33 (or 32) is connected into the first control conduit 39. In the end or second control position 53 the first choke channel 23 (or 24) is no longer effective and each connection is fully open while the first control conduit 39 is interrupted. First control position 52 extends over a considerable range of travel of piston 16 which covers practically the whole range of the fine adjustment of the flow whereas the second control position 53 covers a relatively small portion of travel of piston 16 and corresponds practically to the end working position of the piston.

The operation of control device 10 is as follows:

If pistons 16 of both multiway valves 12 and 13 are in their neutral position, oil or other working fluid delivered by pump 54 flows through piston manometer valve 42 back into return channel 38 formed in connection plate 11. Pressure generated by pump 54 is determined by the force of pressure spring 44 biasing from one end piston 43 of manometer valve 42.

If piston 16 of one multiway valve, for example of valve 12, is shifted from its neutral position 51 (FIG. 2) so the inlet chamber 17 is connected via one of choke channels 23 or 24 to load chamber 18 or 19. For instance, if load chamber 18 is connected to inlet chamber 17 via choke channels 23 and 24, the other load chamber 19 is pressure-released through flow return chamber 22. If load chamber 19 is connected to inlet chamber 17, load chamber 18 is pressure-released through return chamber 21. At the same time, the load chamber 18 or 19 while connected to inlet chamber 17 is connected through axial and radial bores 28 in piston 16 to the third control chamber 27 which in turn communicates via a second control conduit 45 and a non-return valve 46 with the spring-biased end of piston 43 of manometer valve 42. The first control conduit 39 which in the neutral position 51 was open becomes in the first control position 52 choked through the second choke channel 33 or 32. Consequently working oil delivered from pump channel 34 through the first choke 41 can no longer reach the tank through the open first control conduit 39 but is subject to choking. Choke channel 33 or 32 is preferably designed to be as large as to create in the second control channel 26 and thus in piston 43 of piston manometer 42 only such pressure which produces the desired pressure drop across choke channels 23 or 24 in the range of the fine adjustment of piston 16 provided that no load pressure builds up in load chambers 18 and 19. Since the pressure in the second control chamber 26 supplements the bias of spring 44 on piston 43 of manometer valve 42, the piston 43 moves in closing direction to such an extent until pressure builds up in pump channel 34 which is sufficient for operating the load. Simultaneously additional working oil flows due to the load pressure from load chamber 18 or 19 via axial and radial bores 28 in piston 16 into the third control conduit 45 while the pressure of inlet working fluid is admitted in load chamber 18 or 19. Due to the fact, however, that choke channel 33 remains unchanged, an increased pressure builds up also in the second control conduit 45 which acts on spring biased end of piston 43 of manometer valve 42. As soon as the load changes, a pressure drop is created at the inlet side of load chamber 18 or 19 and this pressure drop affects through the bores 28 the pressure fluid control system and prevents a further increase of the pressure. In this manner, a load compensated control of the load is possible over a range of the fine adjustment in which choke channel 23 or 24 is controlled proportionally to the deflection.

As soon as the second control position 53 of piston 16 is reached at the end portion of its stroke, the first control conduit 39 is completely shut off by the control sections of piston 16 adjoining collars 29 and 31. Simultaneously choke channels 23 or 24 become uneffective and the connection to the load is fully open and the pressure compensating meter piston 43 interrupts by the force of biasing spring 44 the connection to flow return channel 38. The whole amount of working fluid delivered by pump 54 flows therefore to the load with the minimum pressure drop determined by the given structure and the load compensation is disconnected.

In this manner the device of this invention makes it possible that in the neutral position of piston 16 the entire amount of working fluid delivered by the pump is returned to the tank with minimum pressure drop, whereas in the range of the fine adjustment of the flow load compensated control takes place with very low power losses and the through-flow is proportional to the adjusted area of control openings, and in the end position of the piston the load compensation is switched off and maximum flow of working oil to the load takes place.

If pistons 16 of both multiway valves 12 and 13 are operated in parallel to resume the first control position 52 in the range of fine adjustment, respective choke channels 33 or 32 become connected in series so that control pressure is correspondingly increased. A further increase of the control pressure and thus the amount of the through-flow is attainable by designing the arrangement of respective borings assigned to choke channels 23 and 24 for tapping off the load pressure such that in the course of the stroke of piston 16 the initially active boring plunges into the inlet chamber 17 and then transmits load pressure increased about pressure drop between inlet chamber 17 and load chamber 18, to piston 43 of manometer valve 42. Non-return valves 48 serve to safeguard the maximum pressure and prevent, during the parallel operation of valves 12 and 13, the streaming of pressure fluid from the direction of high load pressure to the low load pressure.

Figure 3:
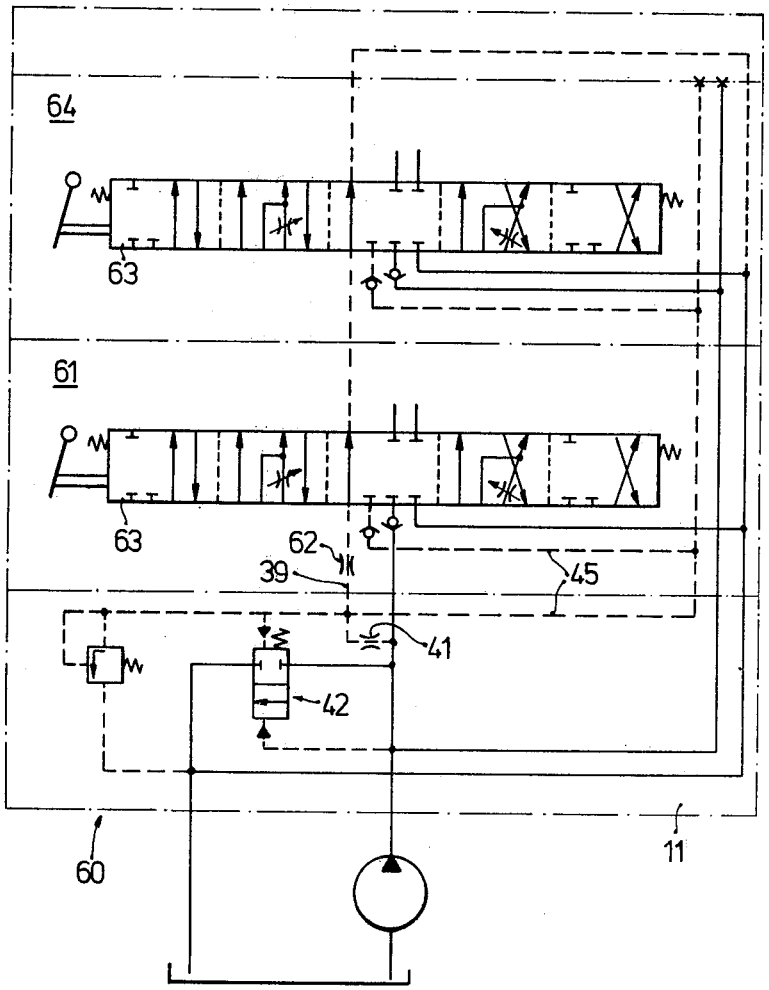
FIG. 3 is a circuit diagram of another embodiment of the device of this invention.

FIG. 3 shows another embodiment of control device 60 of this invention having a first multiway valve 61 which deviates from multiway valve 12 according to FIGS. 1 and 2 in that the second choke 62 is no longer arranged on piston 63 itself but is arranged in the first control conduit 39 in the housing upstream of piston 63. This results in a simpler structure of control device 60 because control collars on the piston are dispensed with. The second choke 62, however, is not disconnectable in the neutral position of piston 61 so that a higher pressure during the neutral circulation takes place. The second multiway valve 64 is now designed without the second choke since its function is taken over by choke 62 in the housing. The second choke 62 can be arranged also in connection plate 11.

Figure 4:
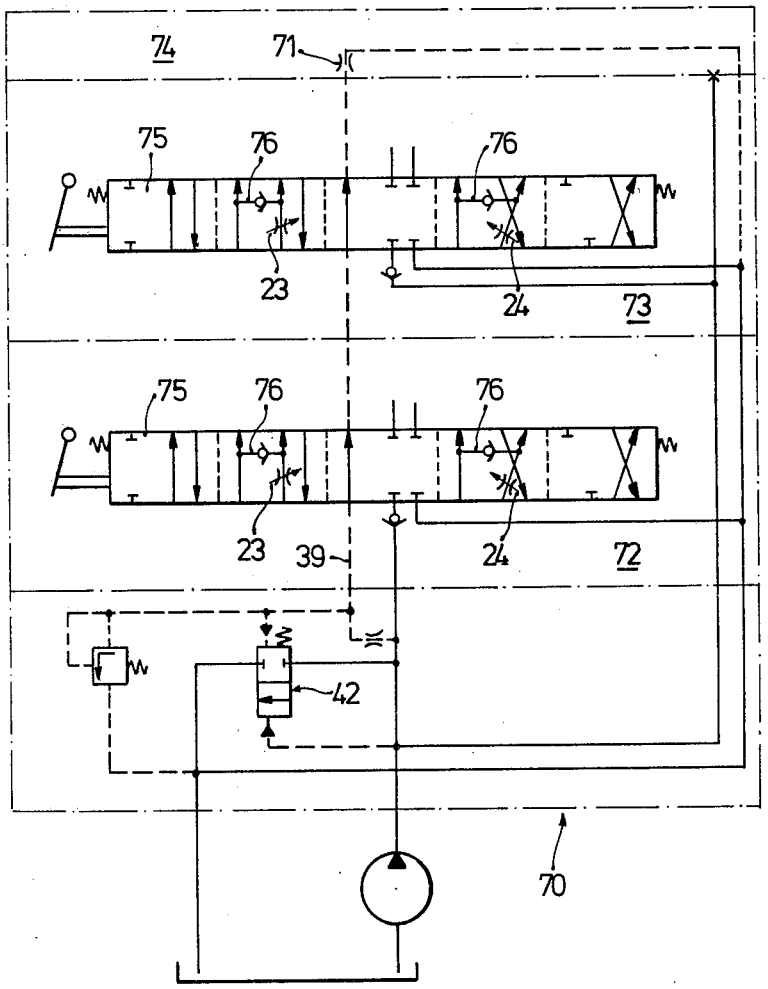
FIG. 4 is a circuit diagram of still another embodiment of the device of this invention.

FIG. 4 shows still another embodiment of the control device of this invention which differs from the preceding control device 60 according to FIG. 3 in the following points: The second choke 71 is arranged in the first control conduits 39 in the terminal plate 74 downstream of the first valve 72 and the second valve 73. In addition, the second control conduit 45 as shown in FIG. 3, is eliminated and the load pressure is directly transmitted through the first control conduit 39 and through corresponding passages in respective pistons 75 and through non-return valve 76. In this manner the most simple and space-saving construction of the control device of this invention is achieved. Nevertheless, the structure of piston 75 has to be provided with non-return valves 76 and the effect of second choke 71 cannot be disconnected when pistons 75 are in their neutral position.

It will be understood that each of the elements described above, or two or more together, may also find a useful application in other types of constructions differing from the types described above. For example, instead of the second control conduit 45 in which load pressures are tapped off in parallel (FIG. 1), each channel 47 can be arranged in the same housing and directed into the first control conduit 39 upstream of the second control chamber 26. Also a modified structure of multiway valves can use borings 28 which instead in the piston are arranged in the housing. It is also possible to employ multiway valves having connection to only one load instead of two loads and the layout of working and controlling chambers can be different from that as illustrated in the preferred embodiments and also the control edges and chokes on respective pistons of the multiway valves can be made differently without departing in any way from the spirit of this invention.

What is claimed as new and desired to be protected by Letters Patent is set forth in the appended claims.

1. In a load independent flow control device for a hydraulically operated load, including at least one multiway control valve having a housing provided with a bore and a piston movable in said bore, said control valve defining at least one choke channel, a pressure fluid inlet channel connectable to a pump, a return channel connectable to a tank and a load channel connectable to a load, the control valve connecting via the choke channel, in an intermediate position of the piston, the load channel to the inlet channel, and in an end position of the piston, the load channel to the return channel, a combination comprising a manometer valve having a manometer piston biased at one end by a spring and connected at the other end to the inlet channel, a pressure difference across said choke channel being applied to both ends of the manometer piston to maintain a constant pressure difference across said choke channel, a first control conduit including a control choke and being connected to the inlet channel and, through said control choke and said control valve, to the return channel, said first control conduit having a branch conduit connected downstream of said control choke to the spring biased end of the manometer piston; an additional choke channel provided in said control valve and connectable, in said intermediate control position of the control valve piston in which the first-mentioned choke channel is effective and said first control conduit is open, to said branch conduit of said first control conduit to increase the spring bias on the manometer piston, the control valve piston being further movable into said end control position in which the first-mentioned choke channel is ineffective and the first control conduit is interrupted.

2. The combination as defined in claim 1, wherein the additional choke channel is disconnectable from said first control conduit in dependence upon the position of the piston of said multiway control valve.

3. The combination as defined in claim 1, wherein said additional choke channel is arranged on the piston of said multiway control valve and is disconnected from said first control conduit when said control valve piston is in its neutral position and in its end control position, respectively.

4. The combination as defined in claim 3, wherein said multiway control valve further includes two control chambers arranged side-by-side in said bore and said control valve piston in the range of said control chambers defining a control collar between said control chambers, said additional choke channel being formed between said control collar and one of said control chambers and being connected to said first control conduit.

5. The combination as defined in claim 4, wherein said additional choke channel has the form of a groove adjoining the circumference of said collar.

6. The combination as defined in claim 5, further including a third control chamber arranged between the first-mentioned control chambers and the remaining chambers of said multiway control valve, said control valve piston being provided with axial and radial bores for interconnecting said remaining chambers downstream of the first-mentioned choke channel and a second control conduit communicating via said axial and radial bores with said third control chamber and being connected via a non-return valve to the biased end of the manometer piston.

7. The combination as defined in claim 1, wherein said control valve piston has a neutral position and, symmetrically arranged about said neutral position, a pair of intermediate control positions and a pair of end control positions, and in either intermediate position said additional choke channel being connectable through said first control conduit to a free end of said manometer piston.

8. The combination as defined in claim 1, wherein said control conduit includes an additional choke arranged downstream of the first-mentioned choke, and said branch conduit leading to said manometer valve is connected to said first control conduit between said first and second chokes and upstream of said control valve piston.

9. The combination as defined in claim 1, further including an additional choke arranged in said first control conduit downstream of said multiway piston valve.

10. The combination as defined in claim 9, further including at least one non-return valve connected to said multiway control valve to transmit load pressure into said first control conduit.

* * * * *